US006459027B1

(12) United States Patent
Van Dermeulen

(10) Patent No.: US 6,459,027 B1
(45) Date of Patent: Oct. 1, 2002

(54) QUICK RELEASE BRACKET HOLDER FOR PERCUSSION INSTRUMENTS

(75) Inventor: John Van Dermeulen, Brunssum (NL)

(73) Assignee: Pearl Musical Instrument Company, Chiba (JP)

( * ) Notice: Subject to any disclaimer, the term of this patent is extended or adjusted under 35 U.S.C. 154(b) by 0 days.

(21) Appl. No.: 09/772,884

(22) Filed: Jan. 31, 2001

(51) Int. Cl.[7] ..... G10D 13/02

(52) U.S. Cl. ..... 84/421; 84/453; 84/327; 84/329

(58) Field of Search ..... 84/421, 327, 329, 84/453

(56) References Cited

U.S. PATENT DOCUMENTS 4,759,252 A * 7/1988 Occhipinti ..... 84/387 A
4,979,273 A * 12/1990 Friedrickson, Jr. et al. ... 24/525
5,156,508 A * 10/1992 Grisley ..... 411/354
5,961,109 A * 10/1999 Dykstra et al. ..... 269/228
6,158,730 A * 12/2000 Coffey ..... 269/236
6,225,542 B1 * 5/2001 Hall ..... 84/421

* cited by examiner

*Primary Examiner*—Shih-Yung Hsieh
(74) *Attorney, Agent, or Firm*—Liniak, Berenato, Longacre & White

(57) ABSTRACT

A novel arrangement of a quick release bracket holder for supporting a pair of conga drums on a floor-standing stand through a conga drum holder bracket. The bracket holder comprises a stationary base plate, and a clamp plate disposed parallel to the base plate and movable toward and away therefrom between an open position and a clamping position. The base plate is provided with two pairs of mounting posts adapted to be inserted into corresponding holes in the holder bracket. The clamp plate is provided with two pairs of cylindrical clamping members complementary to the mounting posts of the base plate. The bracket holder further includes a cam actuator provided to apply an axial force to the clamp plate for moving it toward the base plate in order to clamp the drum holder bracket between the base plate and the clamping members of the clamp plate. The quick release bracket holder also includes a pair of guiding posts extending from the base plate and provided to maintain a proper orientation of the clamp plate relative to the base plate.

19 Claims, 8 Drawing Sheets

QUICK RELEASE BRACKET HOLDER FOR PERCUSSION INSTRUMENTS

BACKGROUND OF THE INVENTION

1. Field of the Invention

The present invention relates to musical instrument holders, and more particularly to a quick release bracket holder for mounting percussion instruments, such as conga and other drums.

2. Description of the Prior Art

Typically, as illustrated in FIG. 1, for ease of play, musicians mount percussion instruments, such as conga drums 2, on a floor-standing stand 4. Most commonly, the floor-standing stand 4 of the prior art carries two drums 2 through L-shaped holder brackets 10 secured to the drums 2 as shown in FIG. 3. The floor-standing stand 4, illustrated in detail in FIG. 2, comprises a support leg 6 provided with a support plate 7 on an upper end thereof. The support plate 7 includes two sets of vertically oriented threaded posts 8 each complemented with a winged nut 9. Referring now to FIG. 3, the conventional L-shaped holder bracket 10 includes an attachment surface 12 fastened to the drum 2 preferably by means of bolts 18, and a holding surface 14 substantially perpendicular to the attachment surface 12. The holding surface 14 is provided with a set of two holes 16 provided for slidable engagement with the associated threaded post 8 of the support plate 7 in the assembled state. Then wing nuts 9 are threaded to the posts 8 to secure the drum 2 to the stand 4 and complete the assemblage, as illustrated in FIG. 4.

Thus, the conventional attachment has relatively complicated construction and is slow, cumbersome and tedious to operate.

Therefore, there is a need for a quick release drum bracket holder, which is simple and easy to operate.

SUMMARY OF THE INVENTION

The present invention provides a quick release bracket holder provided for mounting percussion instruments, such as conga drums, provided with L-shaped brackets to a floorstanding stand.

The quick release bracket holder in accordance with the preferred embodiment of the present invention includes a stationary base plate, and a clamp plate disposed parallel to the base plate and movable toward and away therefrom between an open position and a clamping position. The base plate is provided with two pairs of mounting posts adapted to be inserted into corresponding holes in the holder bracket. The clamp plate is provided with two pairs of cylindrical clamping members complementary to the mounting posts of the base plate. The bracket holder further includes a cam actuator provided to apply an axial force to the clamp plate for moving it toward the base plate in order to clamp the drum holder bracket between the base plate and the clamping members of the clamp plate. The cam actuator includes a pivoting cam member manually manipulated by a cam handle.

The quick release bracket holder also includes a pair of guiding posts extending from the base plate and provided to maintain a proper orientation of the clamp plate relative to the base plate. Each guidepost is provided with a corresponding coil spring mounted about the guidepost between the base plate and the clamp plate in order to bias them apart.

Therefore, the quick release bracket holder in accordance with the present invention provides a simple, inexpensive and easy to operate holder for percussion instruments, such as conga drums. The quick release bracket holder of the present invention eliminates the need for threaded posts and wing nuts of the current floor-standing conga stands.

BRIEF DESCRIPTION OF THE DRAWINGS

Other objects and advantages of the invention will become apparent from a study of the following specification when viewed in light of the accompanying drawings, wherein.

DETAILED DESCRIPTION OF PREFERRED EMBODIMENTS

Figure 1:
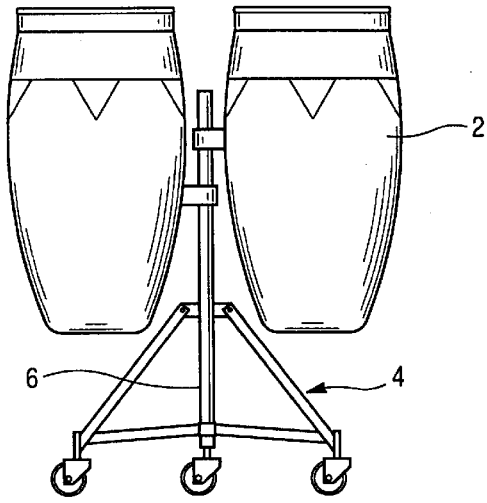
Fig. 1 Prior Art
FIG. 1 is a perspective view of conga drums carried by a floor-standing drum stand.
Figure 2:
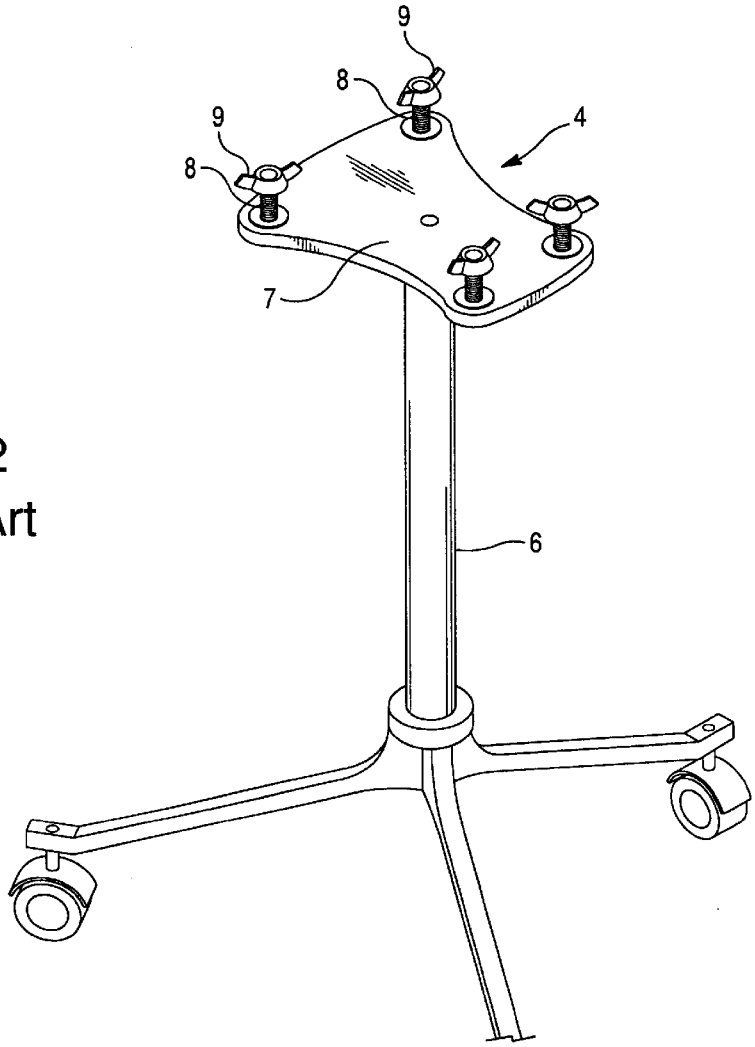
Fig. 2 Prior Art
FIG. 2 is a perspective view of the floor-standing drum stand including a bracket holder according to the prior art.
Figure 3:
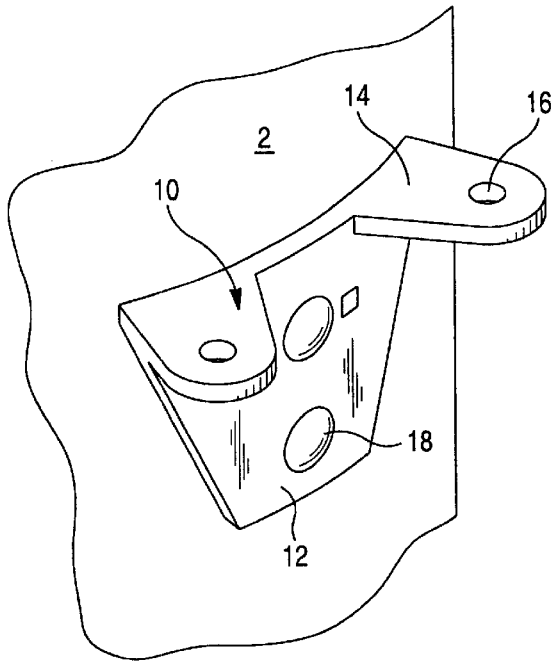
Fig. 3 Prior Art
FIG. 3 is a partial perspective view of the conga drum provided with an L-shaped holder bracket.
Figure 4:
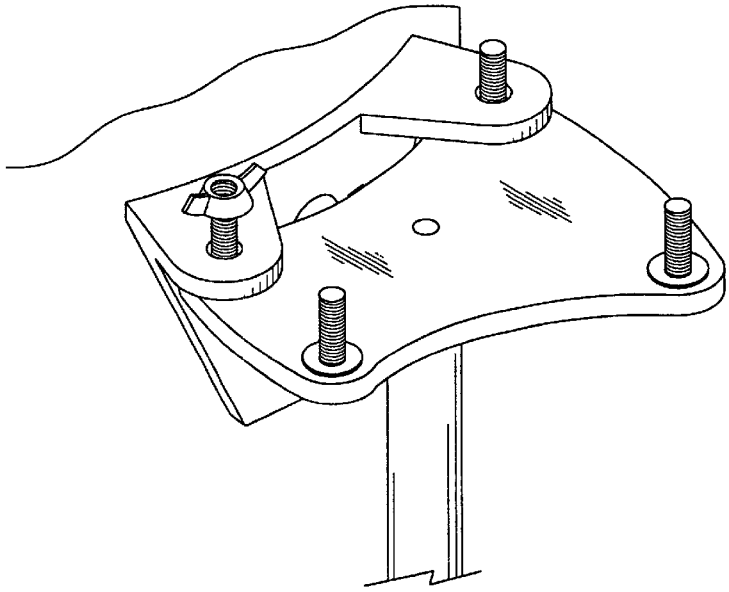
Fig. 4 Prior Art
FIG. 4 is a perspective view of the floor-standing drum stand with the bracket holder carrying the conga drum according to the prior art.
Figure 5:
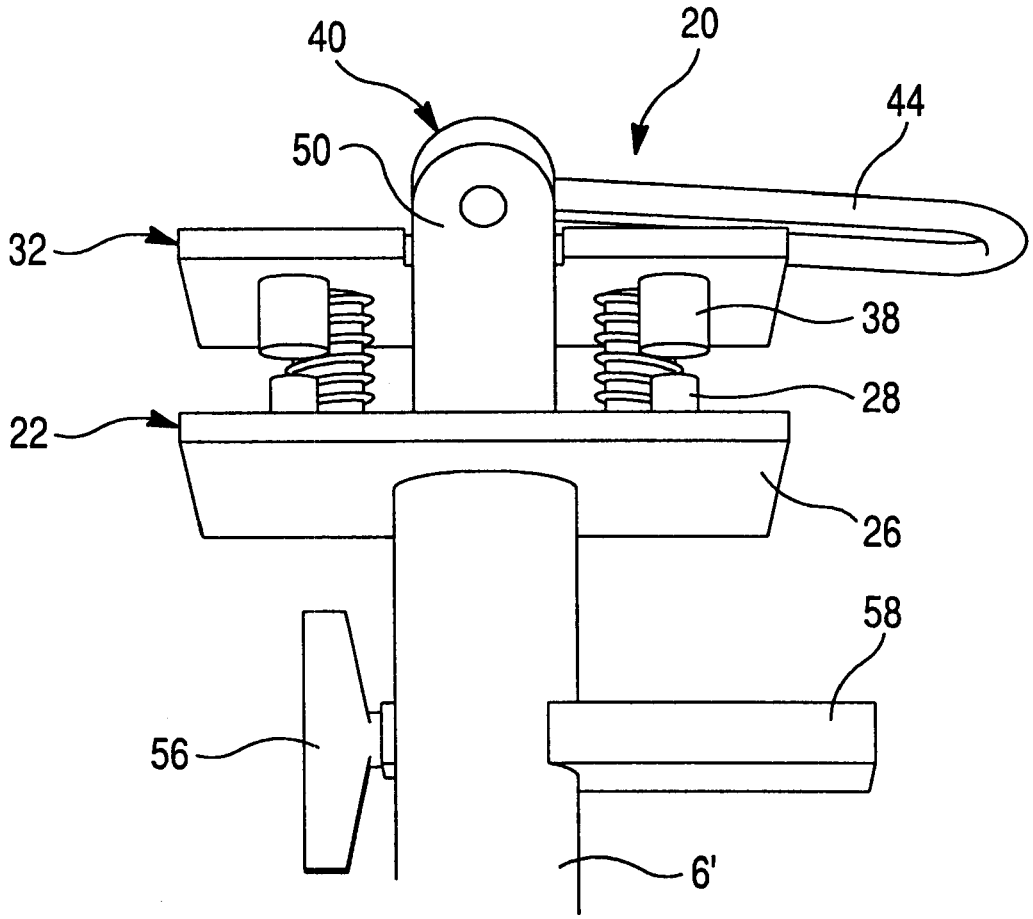
FIG. 5 is a perspective view of the quick release bracket holder according to the present invention.

The preferred embodiment of the present invention will now be described with the reference to accompanying drawings.

FIGS. 5–9B the drawings illustrate in detail the preferred arrangement of a quick release bracket holder 20 in accordance with the present invention. The quick release bracket holder 20 comprises a pair of opposite plates adapted to clamp a drum holder bracket 10 therebetween: a fixed base plate 22 and a clamp plate 32 movable toward and away from the base plate 22 between an open position illustrated in FIGS. 5, 6A, 7A, 8A and 9A, where the bracket 10 is removable from the bracket holder 20, and a clamping position illustrated in FIGS. 6B, 7B, 8B and 9B, where the bracket 10 is rigidly secured between the base plate 22 and the clamp plate 32. The quick release bracket holder 20 further includes a cam actuator 40 provided to move the clamp plate 32 toward the base plate 22 from the open position to the clamping position.

The base plate 22 has a base surface 24 and a support surface 26. A support leg 6 of a floor-standing drum stand 4 is attached to the support surface 26 by any appropriate means known to those skilled in the art, such as welding, using threaded fasteners, etc.

Figure 10:
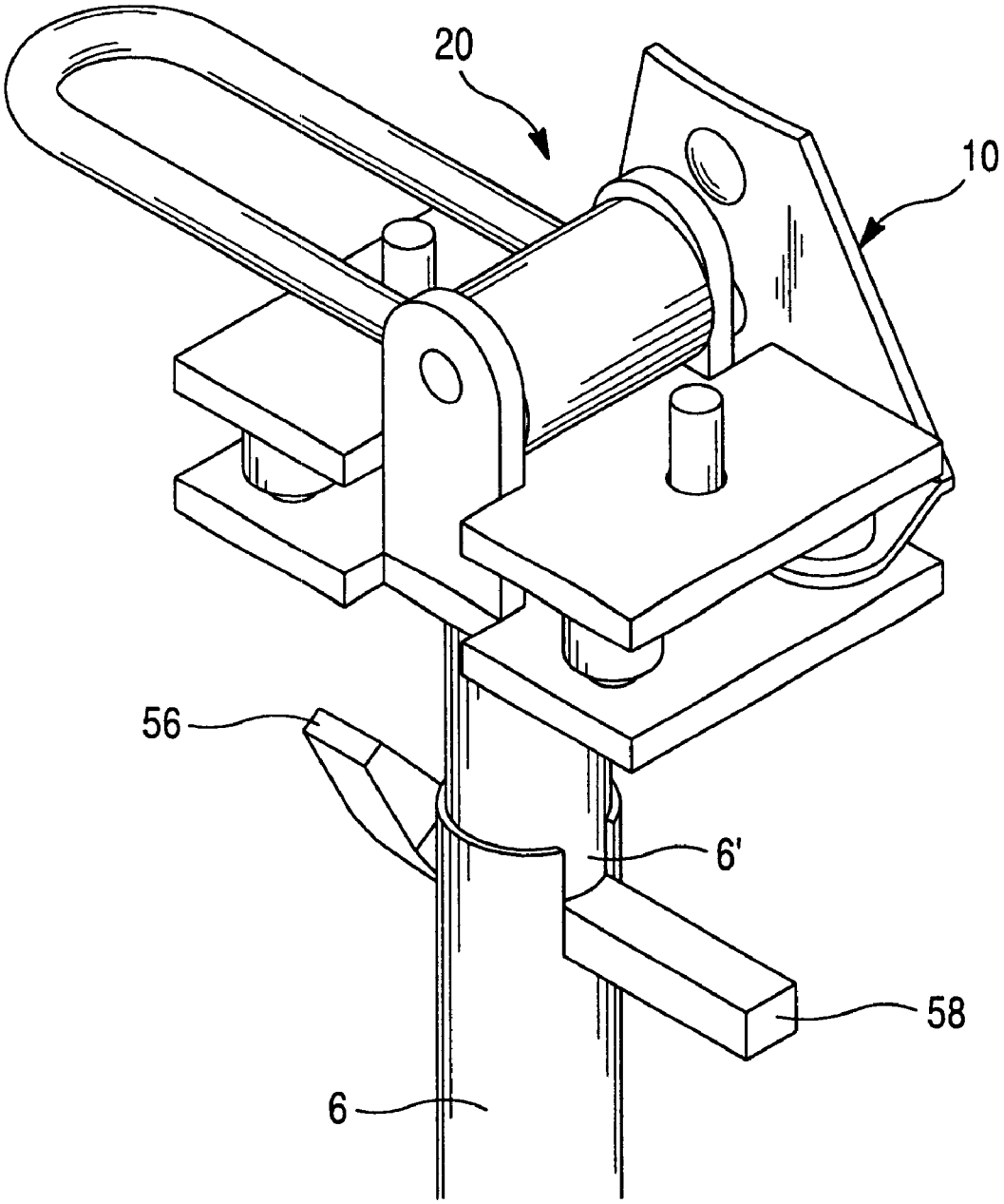
FIG. 10 is a perspective view of the quick release bracket holder according to the present invention removably mounted to the floor-standing drum stand.

Preferably, the bracket holder 20 is removably mounted to the support leg 6 of the floor-standing drum stand 4. In the exemplary embodiment illustrated in FIG. 5, a short support rod 6' is fixed to the support surface 26 of the base plate 22 orthogonally thereto. A cowbell holder 58 may be secured to the support rod 6'. In order to secure the bracket holder 20 to the floor-standing drum stand 4, the support rod 6' is inserted into an open upper end of the tubular support leg 6 and locked thereto by means of a wing bolt 56, as shown in FIG. 10. It would be appreciated that any other appropriate means to removably mount the bracket holder 20 to the floor-standing drum stand 4 is within the scope of the present invention.

Referring again to FIGS. 5, 6A–9B the drawings, the clamp plate 32 has an outer surface 34 and an inner surface 36. The inner surface 36 of the clamp plate 32 faces the base surface 24 of the base plate 22.

Figure 9A:
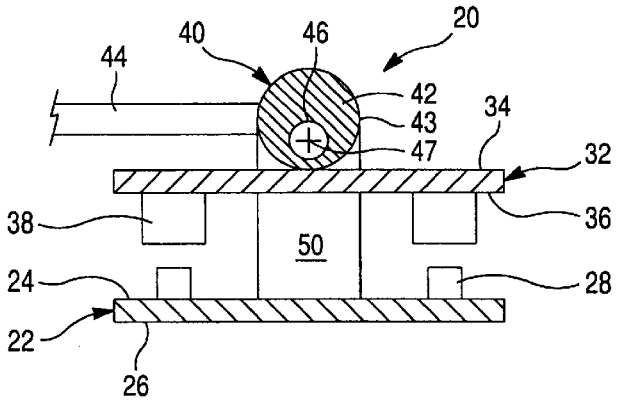
FIG. 9A is a sectional view of a quick release bracket holder according to the present invention in an open position, taken along the line 9A—9A of FIG. 7A.
Figure 9B:
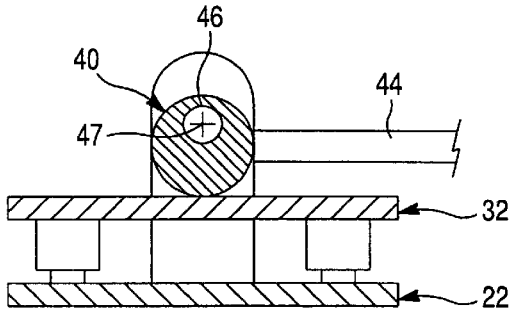
FIG. 9B is a side view of a quick release bracket holder according to the present invention in a clamping position, taken along the line 9B—9B of FIG. 7B.

The cam actuator 40 includes a cam member 42 rotatably mounted to a cam support shaft 46, and a manually operable cam handle 44 attached to the cam member 42 for rotating thereof about a pivot axis 47. The cam member 42 is provided with an eccentric outer surface 43 of incrementally increasing radius from the pivot axis 47, whereby smaller radii are associated with the open position of the bracket holder 20, shown in FIG. 9A, and larger radii are associated with the clamping position, shown in FIG. 9B. As illustrated in FIGS. 9A and 9B, the eccentric outer surface 43 of the cam member 42 abuts the outer surface 34 of the clamp plate 32. Therefore, when the cam handle is rotated clockwise from the position shown in FIG. 9A, the cam member 42 rotates about the cam support shaft 46 and presses the clamp plate 32 downward against the base plate 22, thus generating a clamping force.

In accordance with the preferred embodiment of the present invention, the cam support shaft 46 is secured at its distal ends to a pair of spaced cam support posts 50 extending substantially perpendicularly from the base surface 24 of the base plate 22. Preferably, the cam support shaft 46 is positioned substantially parallel to the base surface 24 of the base plate 22.

Preferably, the bracket holder 20 includes two elongated guideposts 30 secured to the base surface 24 of the base plate 22 by any appropriates means, such as by welding. The guideposts 30 extend substantially vertically from the base surface 24 and through complementary apertures 33 provided in the clamp plate 32 coaxially to the guideposts 30. The guideposts 30 are provided to maintain a proper orientation of the clamp plate 32 relative to the base plate 22. Each guidepost 30 is provided with a corresponding coil spring 52 mounted about the guidepost 30 between the base plate 22 and the clamp plate 32 in order to bias them apart.

Alternatively, the guideposts 30 may be mounted to the clamp plate and extend toward the base plate through complementary apertures provided in the base plate.

Furthermore, the base plate 22 is provided with mounting posts 28 extending substantially vertically from the base surface 24 toward the clamp plate 32. The mounting posts 28 are spaced to a distance corresponding to a distance between the holes 16 in the holding surface 14 of the holder bracket 10 adapted to be mounted over the mounting posts 28. The mounting posts 28 are designed to facilitate positioning and mounting holder bracket 10 to the bracket holder 20. Preferably, the base plate 22 includes two sets of the mounting posts 28 in order to allow each quick release bracket holder 20 to hold two holder brackets 10. Correspondingly, the clamp plate 32 is provided with complementary clamping members 38 extending substantially vertically from the inner surface 36 toward the base plate 22. Each of the clamping members 38 is in the form of a cylinder mounted to the inner surface 36 opposite the corresponding mounting post 28, and adapted to receive the mounting post 28 therein on the clamping position. In the open position of the bracket holder 20, the clamping members 38 are spaced from the mounting posts 28, so as to allow placing holder brackets 10 over the mounting posts 28. Preferably, the clamp plate 32 includes two sets of the clamping members 38.

Figure 6A:
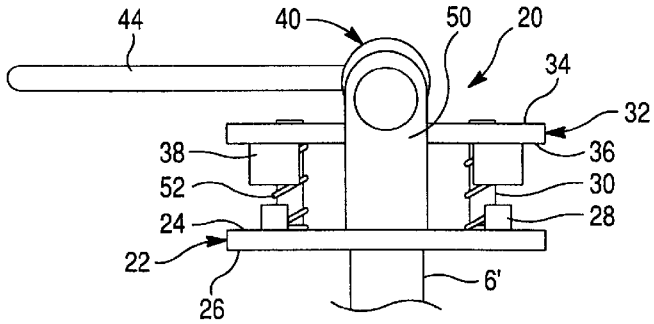
FIG. 6A is an elevation view of a quick release bracket holder according to the present invention in an open position.
Figure 6B:
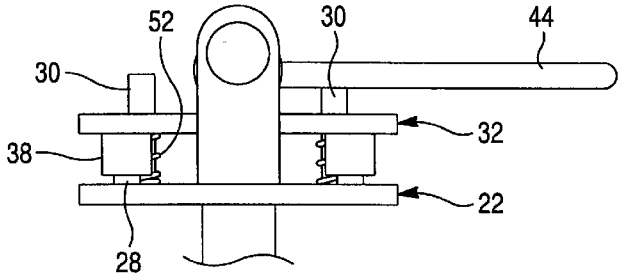
FIG. 6B is an elevation view of a quick release bracket holder according to the present invention in a clamping position.
Figure 7A:
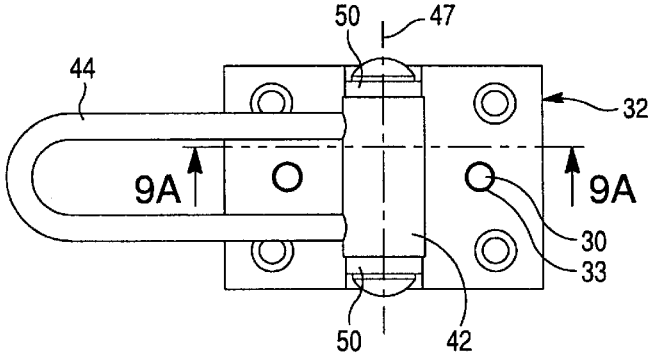
FIG. 7A is a top view of a quick release bracket holder according to the present invention in an open position.
Figure 7B:
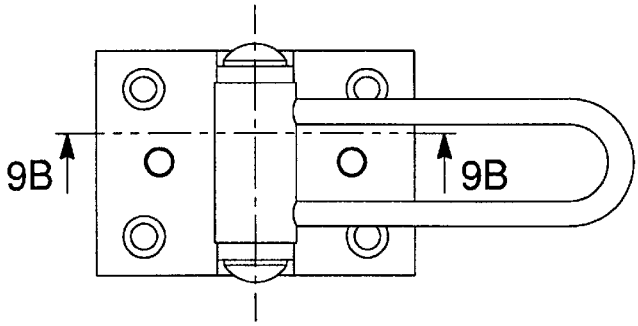
FIG. 7B is a top view of a quick release bracket holder according to the present invention in a clamping position.
Figure 8A:
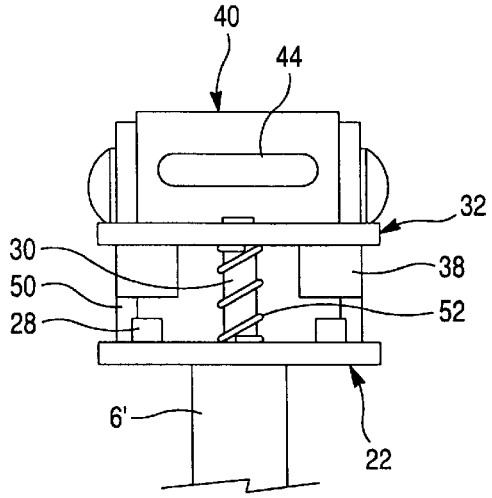
FIG. 8A is a side view of a quick release bracket holder according to the present invention in an open position.
Figure 8B:
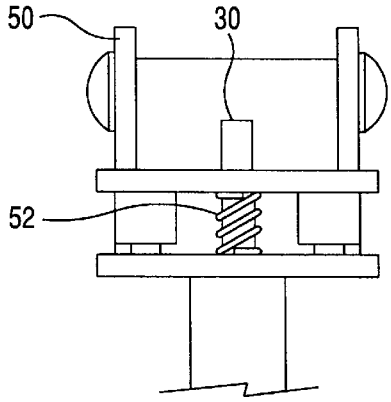
FIG. 8B is a side view of a quick release bracket holder according to the present invention in a clamping position.
Figure 11A:
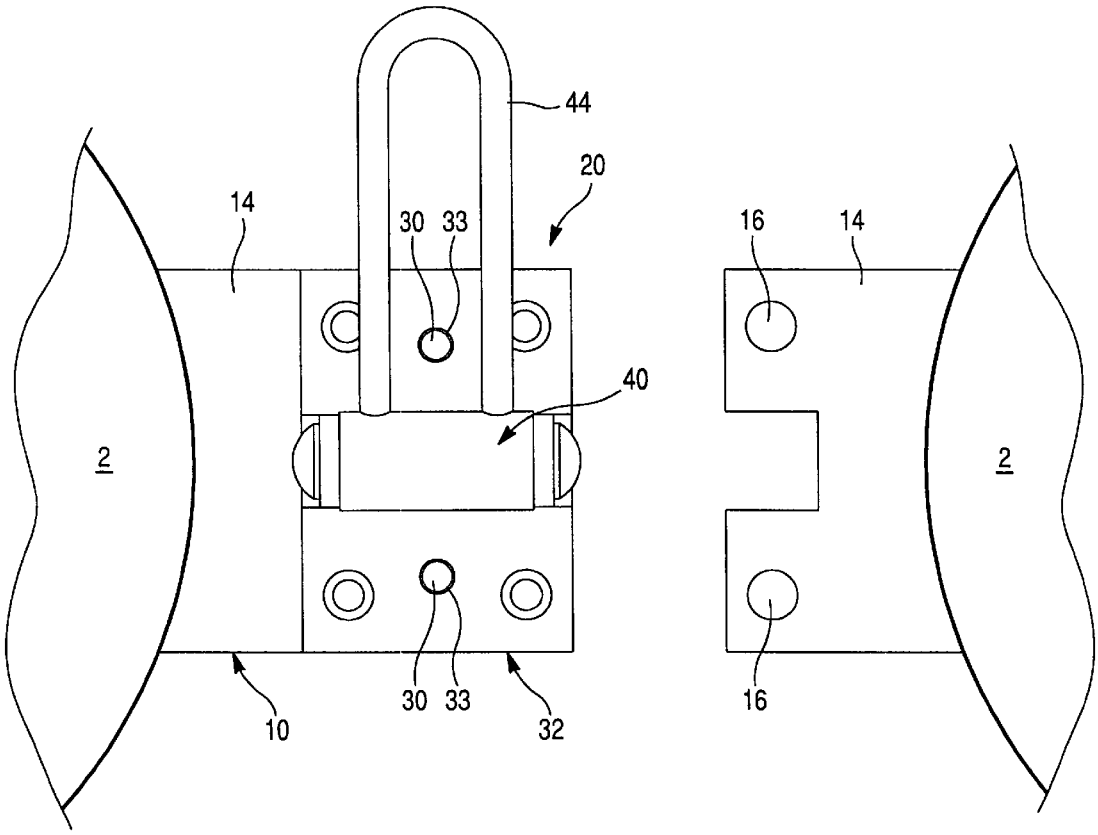
FIG. 11A is a top view of a floor-standing drum stand including quick release bracket holder according to the present invention in an open position.
Figure 11B:
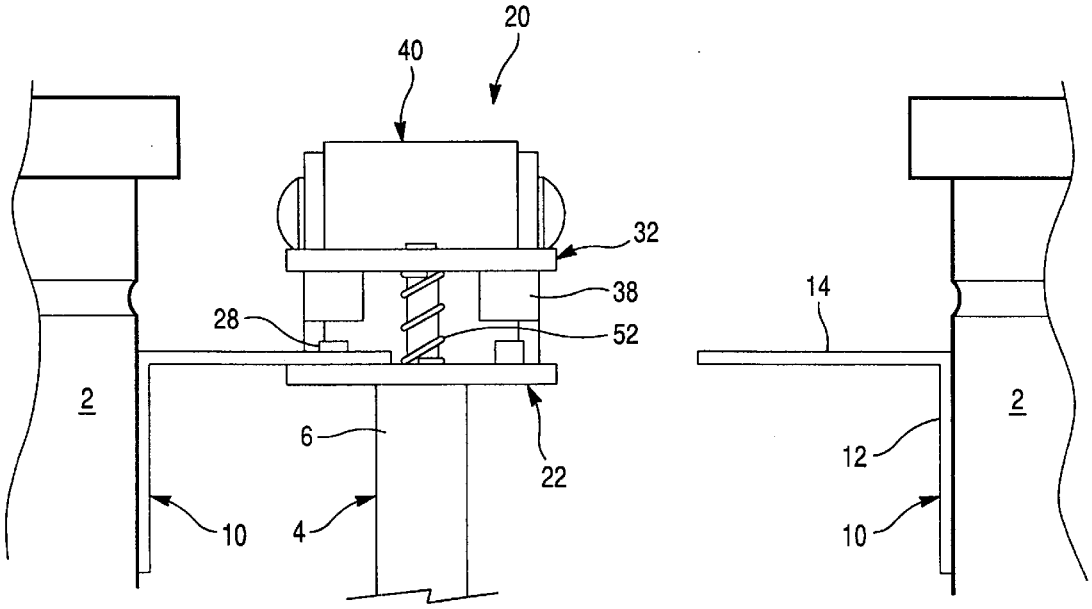
FIG. 11B is a side view of the floor-standing drum stand including quick release bracket holder according to the present invention in the open position.
Figure 12A:
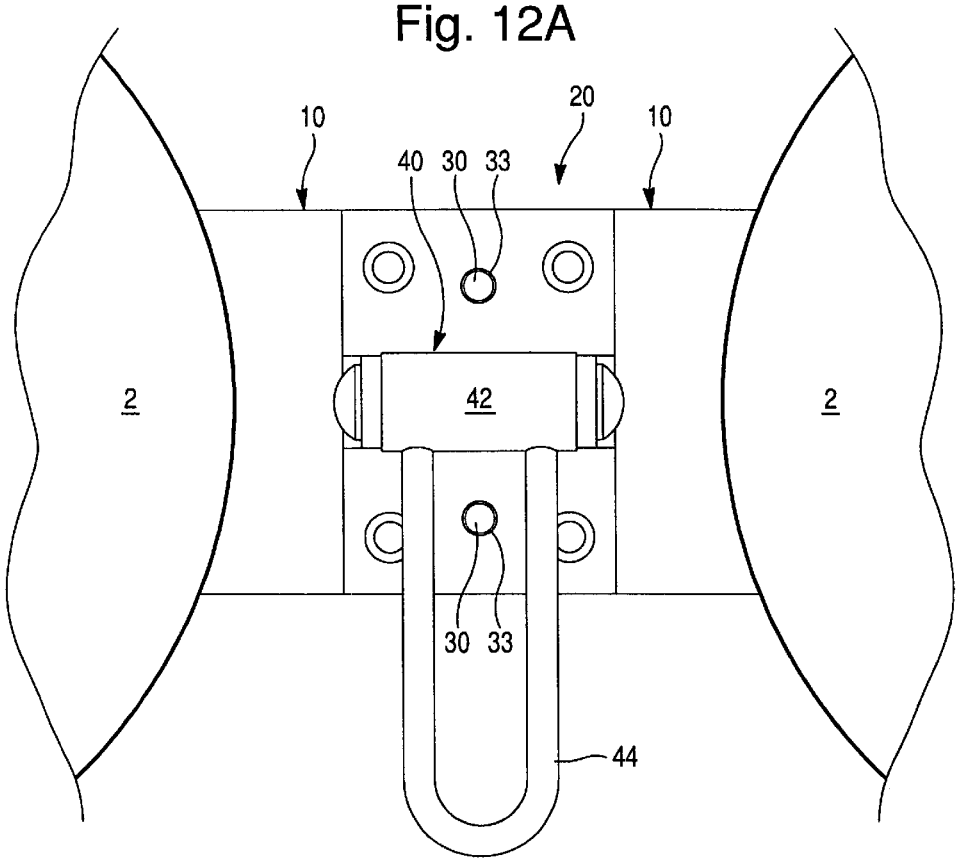
FIG. 12A is a top view of a floor-standing drum stand including quick release bracket holder according to the present invention in an clamping position.
Figure 12B:
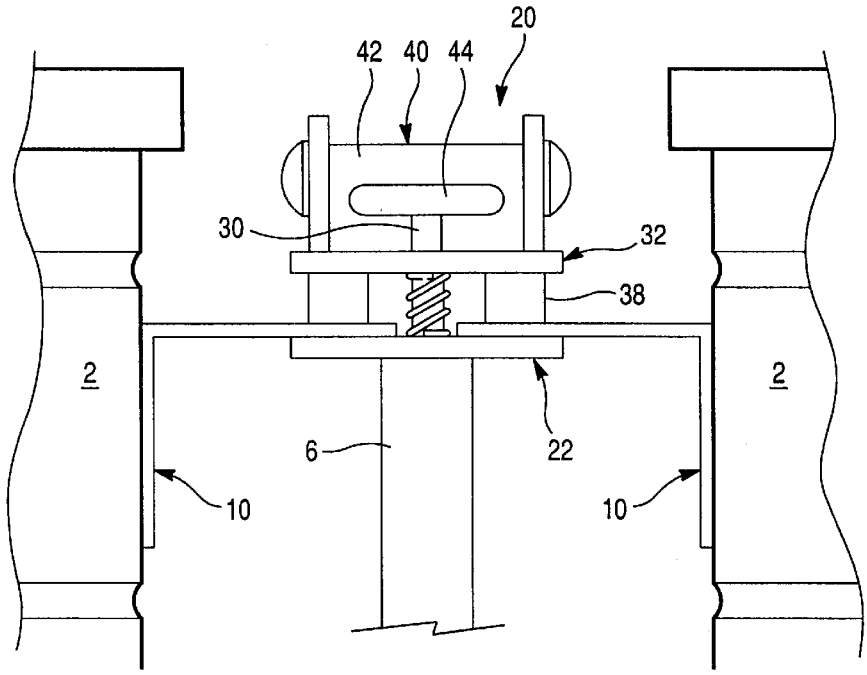
FIG. 12B is a side view of the floor-standing drum stand including quick release bracket holder according to the present invention in the clamping position.

In operation, first the bracket holder 20 is opened by rotating the cam handle 44 into the open position, as shown in FIG. 6A. Then the holder bracket 10 of the conga drum 2 is mounted to the bracket holder 20 by fitting bracket holes 16 onto the pair of the mounting posts 28 of the base plate 22, as illustrated in FIGS. 11A and 11B. Finally, the cam handle 44 is rotated to move the clamp plate 32 into the clamping position, wherein the holder bracket 10 is clamped between the base plate 22 and the pair of the clamping members 38, as illustrated in FIGS. 12A and 12B.

Therefore, the quick release bracket holder 20 in accordance with the present invention represents a novel arrangement of the bracket holder that is simple and easy to operate.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A quick release bracket holder for removably holding at least one article-supporting bracket secured to an article, said holder comprising:

a base plate having a base surface and a support surface;

a clamp plate disposed substantially parallel to said base plate and movable toward and away from said base plate between an open position where said bracket is removable from said bracket holder and a clamping position where said bracket is secured between said base plate and said clamp plate;

said clamp plate having an outer surface and an inner surface wherein said base surface of said base plate faces said inner surface of said clamp plate;

a cam actuator supported on said base plate for selectively moving said clamp plate toward said clamping position, said cam actuator including a rotatable cam member engaging said outer surface of said clamp plate, wherein rotation of said cam member about a pivot axis generates a clamping force urging said clamp plate toward said clamping position, wherein said article supporting bracket includes at least one mounting hole and said base surface of said base plate provided with at least one mounting post, said at least one mounting post is spaced from said clamp plate in said open position so as to allow said bracket to be placed on said base plate by receiving said at least one mounting post in said at least one mounting hole, and said article supporting bracket is adapted to be secured between said base plate and said clamp plate in said clamping position upon rotation of said cam member with said at least one mounting post engaging said at least one mounting hole.

2. The quick release bracket holder as defined in claim 1, wherein said cam member having an eccentric outer surface of incrementally increasing radius from said pivot axis whereby smaller radii are associated with said open position and larger radii are associated with said clamping position.

3. The quick release bracket holder as defined in claim 1, wherein said cam actuator further including a manually operable handle connected to said cam member for operating said cam actuator.

4. The quick release bracket holder as defined in claim 1, wherein said base plate is provided with at least one cam support post for pivotally supporting said cam member.

5. The quick release bracket holder as defined in claim 1, further comprising at least one guidepost extending substantially vertically from said base surface of said base plate, said guidepost cooperating with a complementary aperture provided in said clamp plate, said guidepost provided to maintain a proper orientation of said clamp plate relative to said base plate.

6. The quick release bracket holder as defined in claim 1, further comprising at least one spring member disposed between said base surface of said base plate and said inner surface of said clamp plate biasing said clamp plate toward said open position.

7. The quick release bracket holder as defined in claim 6, wherein said spring member is a coil spring.

8. The quick release bracket holder as defined in claim 7 wherein said coil spring is mounted about said guidepost.

9. The quick release bracket holder as defined in claim 1, wherein said bracket holder is secured to a floor-standing support stand for supporting said article on a floor.

10. The quick release bracket holder as defined in claim 9, wherein said bracket holder is removably secured to said floor-standing support stand.

11. The quick release bracket holder as defined in claim 1, wherein said article is a percussion instrument including at least one drum supporting bracket secured thereto, said bracket having a substantially planar holding surface provided with two mounting holes, said bracket holder further including a pair of mounting posts fixed to said base surface of said base plate and spaced from said clamp plate in said open position so as to allow said bracket to be placed on said base plate by receiving said mounting posts in said mounting holes, said article supporting bracket is provided to be secured between said base plate and said clamp plate in said clamping position upon rotation of said cam member with said mounting posts engaging said mounting holes.

12. The quick release bracket holder as defined in claim 11, wherein said percussion instrument is a drum.

13. A quick release bracket holder for removably holding at least one article-supporting bracket secured to an article, said holder comprising:

a base plate having a base surface and a support surface;

a clamp plate disposed substantially parallel to said base plate and movable toward and away from said base plate between an open position where said bracket is removable from said said clamp plate having an outer surface and an inner surface wherein said base surface of said base plate faces said inner surface of said clamp plate;

a cam actuator supported on said base plate for selectively moving said clamp plate toward said clamping position, said cam actuator including a rotatable cam member engaging said outer surface of said clamp plate, wherein rotation of said cam member about a pivot axis generates a clamping force urging said clamp plate toward said clamping position, wherein said article supporting bracket including at least one mounting hole and said base surface of said base plate provided with at least one mounting post provided to be received in said mounting hole in said bracket when said bracket holder is in said open position, and said quick release bracket holder further including at least one clamping member complementary to said mounting post, said clamping member is fixed to said inner surface of said clamp plate and provided to press said bracket to said base surface of said base plate in said clamping position.

14. The quick release bracket holder as defined in claim 13, wherein said clamping member is provided with an aperture coaxial to said mounting post and adapted to receive said mounting post therewithin in said clamping position.

15. The quick release bracket holder as defined in claim 14, wherein said article supporting bracket includes a set of mounting holes, said base surface of said base plate is provided with at least one set of corresponding mounting posts and said outer surface of said clamp plate is provided with at least one set of complimentary clamping members.

16. The quick release bracket holder as defined in claim 15, wherein said article supporting bracket includes two mounting holes.

17. A quick release bracket holder for removably holding at least one drum supporting bracket secured to a conga drum, said bracket having two mounting holes, said bracket holder comprising:

a base plate having a base surface and a support surface;

a clamp plate disposed substantially parallel to said base plate and movable toward and away from said base plate between a clamping position where said bracket is rigidly secured between said base plate and said clamp plate and an open position where said bracket is said clamp plate having an inner surface and an outer surface wherein said base surface of said base plate faces said inner surface of said clamp plate;

said base plate is provided with two spaced cam support posts, said support posts extending substantially perpendicularly from said base plate;

a cam actuator having a cam member pivotally supported on said cam support posts for rotation about a pivot axis substantially parallel to said outer surface of said clamp plate and a manually operable handle connected to said cam member for rotating said cam member;

said cam member having an eccentric outer surface of incrementally increasing radius from said pivot axis whereby smaller radii are associated with said open position and larger radii are associated with said clamping position, wherein rotation of said cam member about said pivot axis generates a clamping force urging said clamp plate between said open and said clamping positions;

said eccentric outer surface of said cam member engaging said outer surface of said clamp plate;

two guideposts extending substantially vertically from said base surface of said base plate, said guideposts cooperating with complementary apertures provided in said clamp plate so that said guideposts extend through said apertures in said clamp plate, said guidepost provided to maintain a proper orientation of said clamp plate relative to said base plate;

two coil springs mounted about said guide posts for biasing said clamp plate toward said open position;

at least a pair of mounting posts fixed to said base surface of said base plate, each of said pairs of mounting posts provided to receive said mounting holes in said holder bracket;

at least a pair of clamping members complementary to said mounting posts, each of said clamping members is fixed to said inner surface of said clamp plate and is provided with an aperture coaxial to said complementary mounting post and adapted to receive said mounting post therewithin in said clamping position, said clamping members are provided to clamp said bracket to said base surface of said base plate in said clamping position.

18. The quick release bracket holder as defined in claim 17, wherein said bracket holder is attached to a floor-standing support stand for supporting said conga drum on a floor.

19. The quick release bracket holder as defined in claim 18, wherein said bracket holder is removably attached to said floor-standing support stand.

* * * * *